US009553395B2

(12) United States Patent
Nagasaki et al.

(10) Patent No.: US 9,553,395 B2
(45) Date of Patent: Jan. 24, 2017

(54) CONNECTOR HAVING A BARREL AND AN END BELL

(71) Applicant: Tyco Electronics Japan G.K., Kanagawa (JP)

(72) Inventors: Taisuke Nagasaki, Kanagawa (JP); Shinji Yamada, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/844,347

(22) Filed: Sep. 3, 2015

(65) Prior Publication Data

US 2016/0072217 A1 Mar. 10, 2016

(30) Foreign Application Priority Data

Sep. 5, 2014 (JP) ..... 2014-181390

(51) Int. Cl.

| | |
|---|---|
| ***H01R 13/502*** | (2006.01) |
| ***H01R 13/52*** | (2006.01) |
| ***H01R 4/30*** | (2006.01) |
| ***H01R 13/02*** | (2006.01) |
| ***H01R 13/506*** | (2006.01) |

(52) U.S. Cl.

CPC ..... *H01R 13/5202* (2013.01); *H01R 4/30* (2013.01); *H01R 13/02* (2013.01); *H01R 13/506* (2013.01)

(58) Field of Classification Search

CPC ..... H01R 13/502; H01R 13/504; H01R 43/24
USPC ..... 439/686, 902, 905, 446
See application file for complete search history.

(56) References Cited

U.S. PATENT DOCUMENTS

| | | | | | |
|---|---|---|---|---|---|
| 2,374,971 | A * | 5/1945 | Benander | H01R 13/56 | 174/59 |
| 2,869,102 | A * | 1/1959 | Hubbell, Jr. | H01R 13/56 | 439/446 |
| 3,675,184 | A * | 7/1972 | Vetter | H01R 13/59 | 439/462 |
| 3,771,108 | A * | 11/1973 | Haffner | H01R 13/6453 | 439/364 |
| 4,364,624 | A * | 12/1982 | Williams | H01R 31/00 | 174/87 |
| 5,882,226 | A * | 3/1999 | Bell | H01R 9/032 | 439/11 |
| 5,911,595 | A * | 6/1999 | Orr, Jr. | H01R 13/58 | 439/471 |
| 7,131,858 | B1 * | 11/2006 | Zerebilov | H01R 9/0518 | 439/446 |
| 7,507,125 | B2 * | 3/2009 | Okamura | H01R 13/506 | 439/680 |

(Continued)

FOREIGN PATENT DOCUMENTS

| | | |
|---|---|---|
| JP | 2001267006 A | 9/2001 |
| JP | 2003208945 A | 7/2003 |
| JP | 201243763 A | 3/2012 |

*Primary Examiner* — Phuong Dinh
(74) *Attorney, Agent, or Firm* — Barley Snyder

(57) ABSTRACT

A connector is provided and includes a barrel, an end bell, an assembly nut, and a securing mechanism. The end bell includes a spring arm and a seat portion. The assembly nut includes a projection disposed on the seat portion and engaging the spring arm to couple the barrel to the end bell. The securing mechanism secures the barrel and the assembly nut to each other.

16 Claims, 12 Drawing Sheets

(56) References Cited

U.S. PATENT DOCUMENTS

| | | | | |
|---|---|---|---|---|
| 8,641,447 | B2 * | 2/2014 | Sykes | H01R 24/44 439/582 |
| 8,968,023 | B1 * | 3/2015 | Walters | H02G 3/0633 439/446 |
| 9,118,158 | B2 * | 8/2015 | Kern | H01R 43/00 |
| 2014/0024266 | A1 * | 1/2014 | Kashiwada | H01R 13/6315 439/686 |

* cited by examiner

CONNECTOR HAVING A BARREL AND AN END BELL

CROSS-REFERENCE TO RELATED APPLICATION

This application claims the benefit of the filing date under 35 U.S.C. §119(a)-(d) of Japanese Patent Application No. 2014-181390 filed on Sep. 5, 2014.

FIELD OF THE INVENTION

The present invention relates to a connector and, more particularly, to a connector coupling a barrel and an end bell to each other by an assembly nut.

BACKGROUND

There are well-known connectors that couple a barrel of a plug with a plurality of contacts to an end bell attached to an end portion of a cable using an assembly nut.

For example, such a known connector is disclosed in Japanese Patent Application No. JP2001-267006A. The known connector shown in JP2001-267006A includes a barrel, an end bell, and an assembly nut coupling the barrel and the end bell to each other. The barrel is positioned along an end portion of the plug receiving a plurality of contacts. The barrel includes a plurality of keys projecting in a radial direction. Alternatively, the end bell includes an end portion having a plurality of key grooves to engage with keys of the barrel. The end bell also includes another end portion provided with a port for drawing out a cable connected to the plurality of contacts. Further, the assembly nut is formed with a plurality of key grooves into which the keys of the barrel are inserted and is held by the end bell to be rotatable by a predetermined angle.

When the connector is assembled, first, the assembly nut is inserted into a distal end portion of the end bell such that key grooves of the end bell and the key grooves of the assembly nut are aligned with each other along a predetermined angle relationship. Next, the keys of the barrel are caused to pass through the key grooves of the assembly nut to be inserted into the key grooves of the end bell, so that locating of the cables in the cable drawing-out direction is performed. Thereafter, the assembly nut is rotated by a predetermined angle so that the barrel and the end bell are secured to each other.

In the known connector shown in JP2001-267006A, however, there is the following problem.

That is, in the case of the known connector shown in JP2001-267006A, when the assembly nut is inserted into the distal end portion of the end bell, a projection of the assembly nut is substantially press-fit into a slot of the end bell. Therefore, a large force is required upon initial assembling, and when disassembling and assembling are repeated, the end bell is scraped, which results in such a problem that a retaining force of the assembly nut to the end bell is lowered.

SUMMARY

Therefore, the present invention has been made in order to solve this problem, and an object thereof, among others, is to provide a connector having a barrel, an end bell, an assembly nut, and a securing mechanism. The end bell includes a spring arm and a seat portion. The assembly nut includes a projection disposed on the seat portion and engaging the spring arm to couple the barrel to the end bell. The securing mechanism secures the barrel and the assembly nut to each other.

BRIEF DESCRIPTION OF THE DRAWINGS

The above and other features of the invention will become more apparent by describing in detail exemplary embodiments thereof with reference to the accompanying drawings, in which.

DETAILED DESCRIPTION OF THE EMBODIMENT(S)

An embodiment of the present invention will be described below with reference to the drawings.

With reference to FIGS. 1 to 7, a connector 1 is provided and includes a barrel 10, an end bell 30, and an assembly nut 40 that couples the barrel 10 and the end bell 30 to each other.

Figure 5:
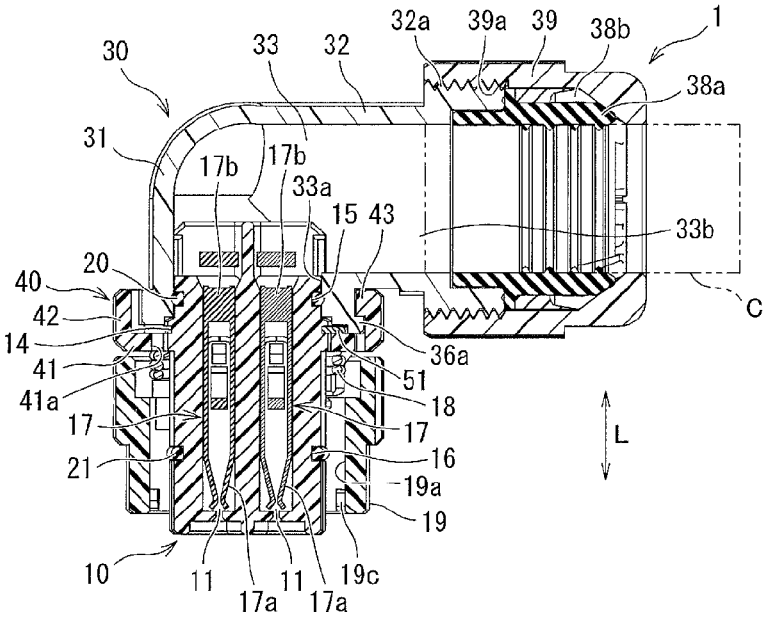
FIG. 5 is a sectional view of the connector of FIG. 2 taken along line 5-5.
Figure 6:
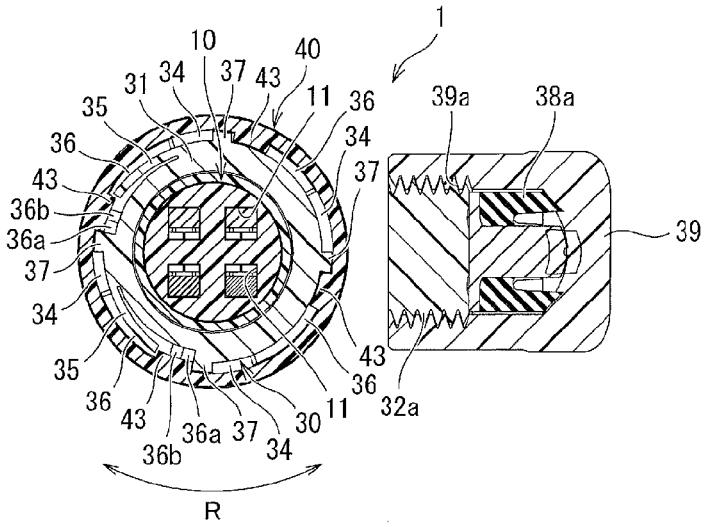
FIG. 6 is a sectional view of the connector of FIG. 4 taken along line 6-6.

In an exemplary embodiment, the barrel 10 is configured to be fitted to a header connector (not shown) that attaches to a casing of a motor (not shown), and is formed in an approximately cylindrical shape by molding synthetic resin. As shown in FIG. 5 and FIG. 6, the barrel 10 is provided with a plurality of (four in this embodiment) contact receiving chambers 11 arranged in two×two. Each contact receiving chamber 11 has an opening along an upper face and a lower face of the barrel 10 in an axial direction shown by arrow L, as shown in FIG. 5.

Figure 7:
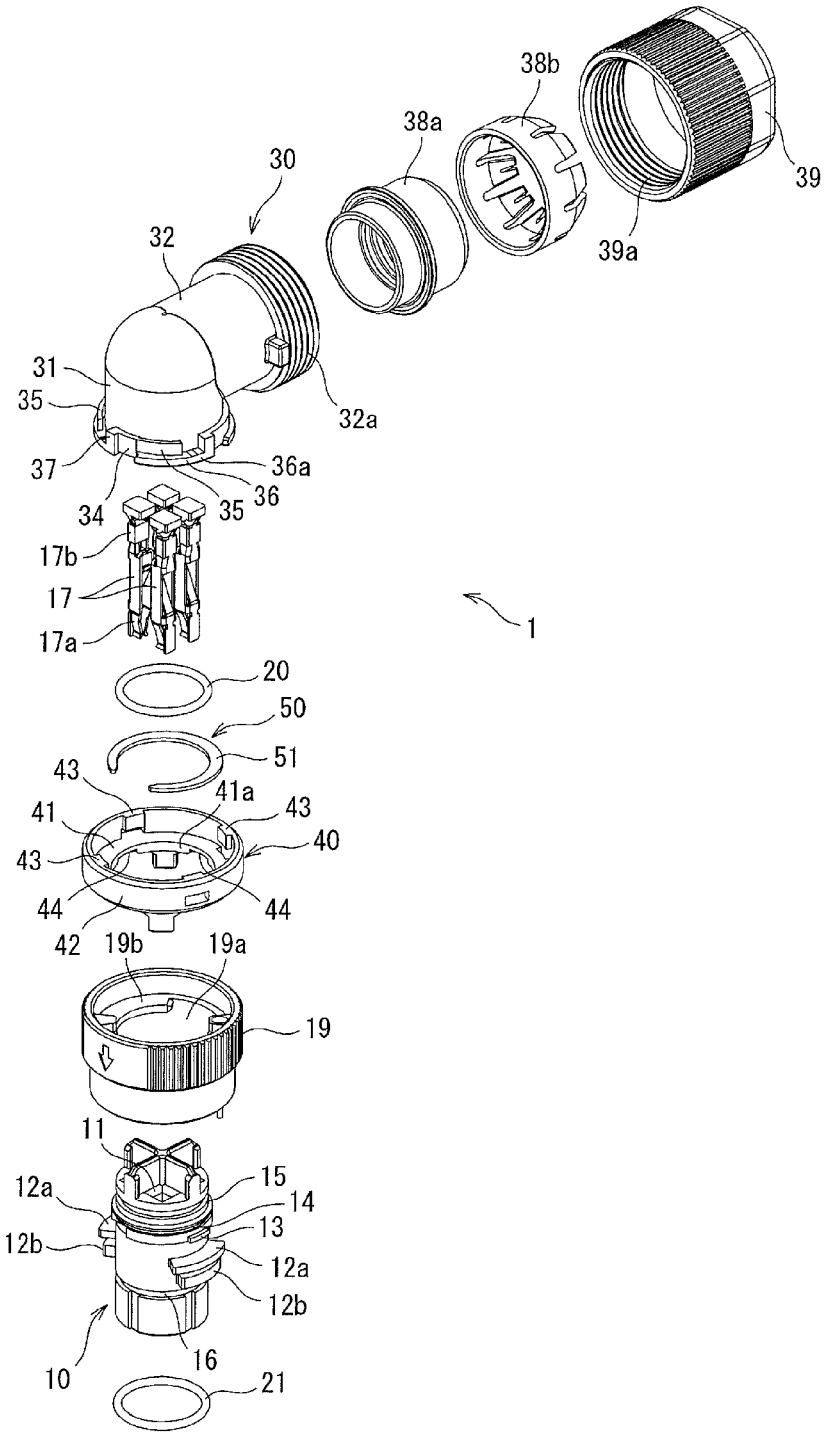
FIG. 7 is an exploded perspective view of the connector shown in FIG. 1.
Figure 8A:
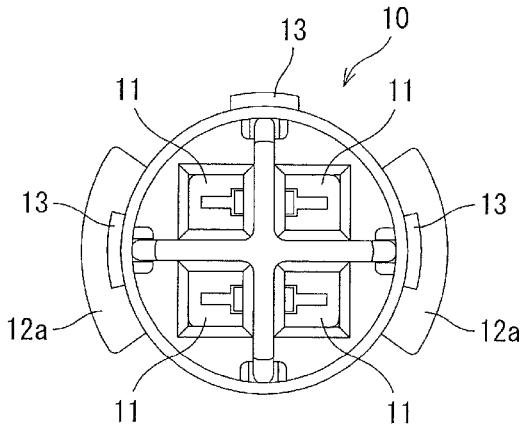
FIG. 8A is a top view of a barrel for the connector shown in FIG. 1.
Figure 8B:
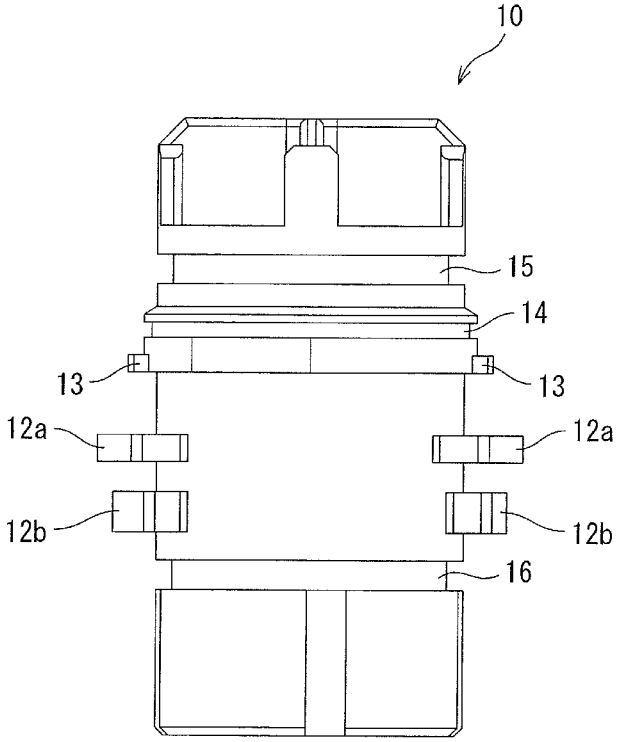
FIG. 8B is a front view of the barrel of FIG. 8A FIG. 1

Further, as shown in FIG. 7, two pairs of upper stoppers 12*a* and lower stoppers 12*b* restrict upward and downward movements of a ring housing 19, described later, along an outer circumferential face of the barrel 10. Each pair of upper stoppers 12*a* and lower stoppers 12*b* are spaced from each other in a vertical direction by a predetermined distance and project from the outer circumference face of the barrel 10. Further, a plurality of (three in this embodiment) keys 13 are formed on an upper side on the outer circumferential face of the barrel 10 beyond the upper stopper 12*a*. The plurality of keys 13 are positioned at 90° intervals of along a circumference of the barrel 10. Further, a circumferential groove 14 for attaching a C ring 51 is formed and provides a securing mechanism 50 on the outer circumferential face of the barrel 10, along an upper side of the barrel 10 that is beyond the keys 13. In addition, an annular first seal groove 15 is provided along the outer circumferential face of the barrel 10 on an upper side of the barrel 10 beyond the circumferential groove 14. A first seal member 20 is to be fitted in the annular first seal groove 15. On the other hand, an annular second seal groove 16 is provided along the outer circumferential face of the barrel 10 on a lower side beyond the lower stopper 12*b*. A second seal member 21 is to be fitted in the annular second seal groove 16.

As shown in FIG. 5, a receptacle type contact 17 is received in each contact receiving chamber 11 of the barrel 10. Each contact 17 is provided with a receptacle type contact portion 17*a* accepting a mating contact (not shown) and an electric wire connection portion 17*b* connected with each electric wire from a cable C (see FIG. 5). Each contact 17 is formed by stamping and forming an electrical conductive metal plate. Each contact 17 is received in each contact receiving chamber 11 such that the contact portion 17*a* is arranged on a lower side and the electrical wire connection portion 17*b* is arranged on an upper side.

Figure 15:
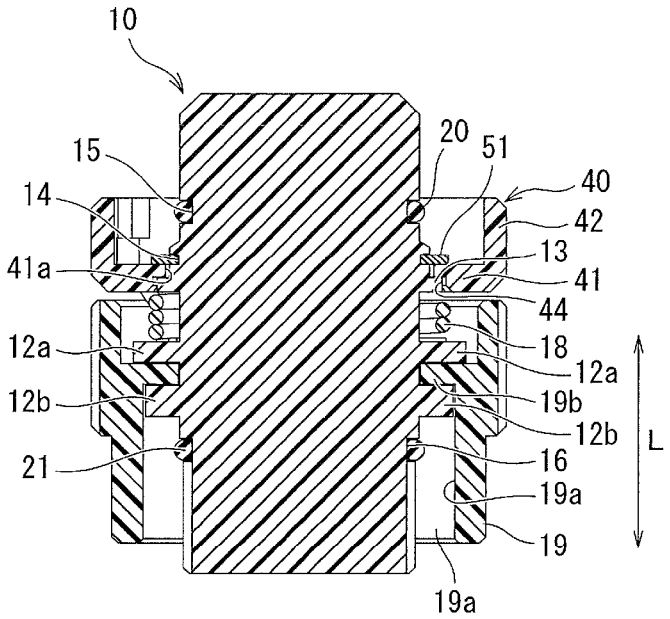
FIG. 15 is a sectional view of the connector of FIG. 14 taken along line 15-15.
Figure 16:
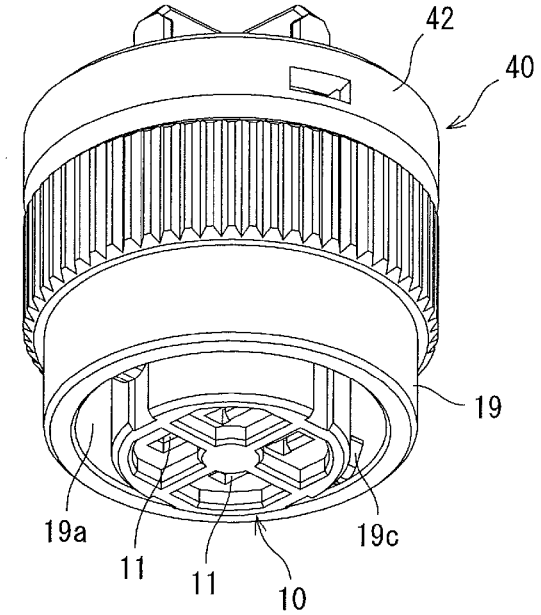
FIG. 16 is a perspective view of an assembly nut secured to a barrel of a connector according to the invention.

As shown in FIG. 5 and FIG. 15, a coil spring 18 is wound on an outer circumference of the barrel 10 between the keys 13 and the upper stoppers 12*a*. One end of the coil spring 18 is secured to the barrel 10, while the other end of the coil spring 18 is secured to a ring housing 19 described later. The coil spring 18 biases the ring housing 19 to the barrel 10 in one direction of rotation directions shown by arrow R.

Figure 9:
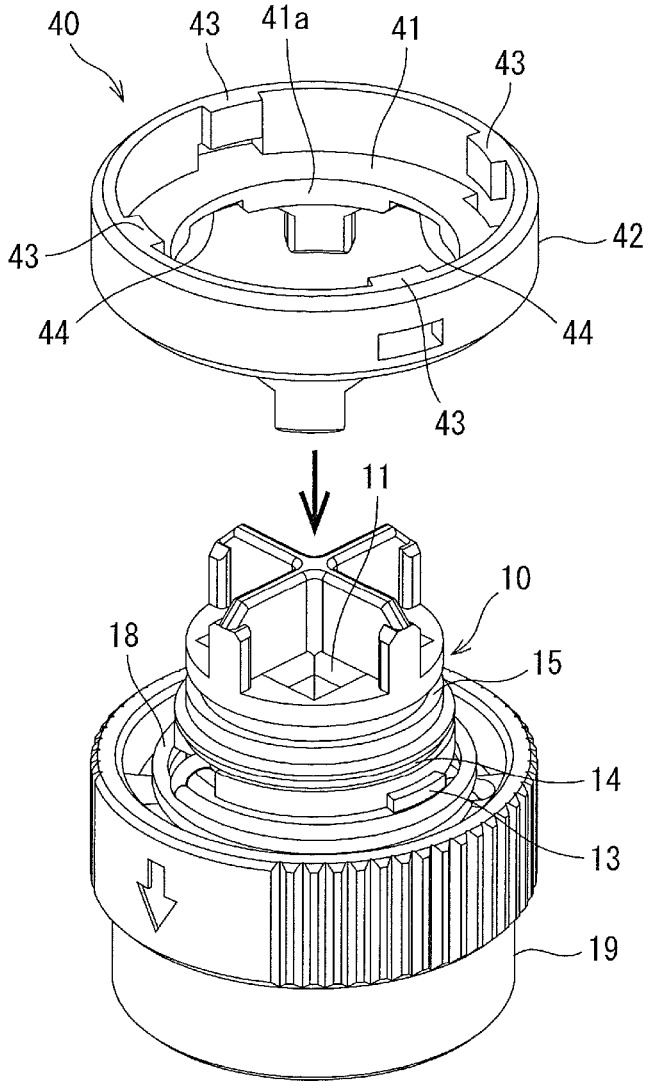
FIG. 9 is a perspective view of an assembly nut and a barrel of the connector shown in FIG. 1.

Further, as shown in FIG. 9, the ring housing 19 is arranged on an outer side of the barrel 10 and covers a lower side of the barrel 10 beyond the keys 13. The ring housing 19 is attached to the barrel 10 so as to be rotatable in rotation directions shown by arrow R (see FIG. 1). The ring housing 19 is formed by molding synthetic resin. As shown in FIG. 7 and FIG. 15, the ring housing 19 is formed in an annular shape having a through-hole 19*a* extending through in a vertical direction. Further, an annular plate 19*b* projecting inward is provided on an inner circumferential face of the housing 19 along an approximately vertically central portion. As shown in FIG. 15, the annular plate 19*b* is fitted between the upper stopper 12*a* and the lower stopper 12*b* of the barrel 10. Thereby, the ring housing 19 is attached to the barrel 10 rotatably in a state where movement thereof has been restricted. Further, a cam projection 19*c* (see FIG. 5) is provided on the inner circumferential face of the ring housing 19 along a lower end of the ring housing 19.

Figure 1:
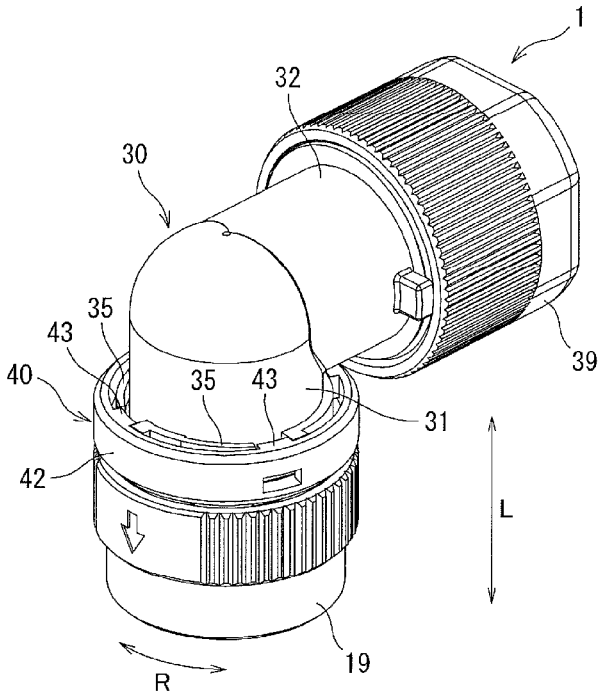
FIG. 1 is a perspective view of a connector according to the invention.
Figure 2:
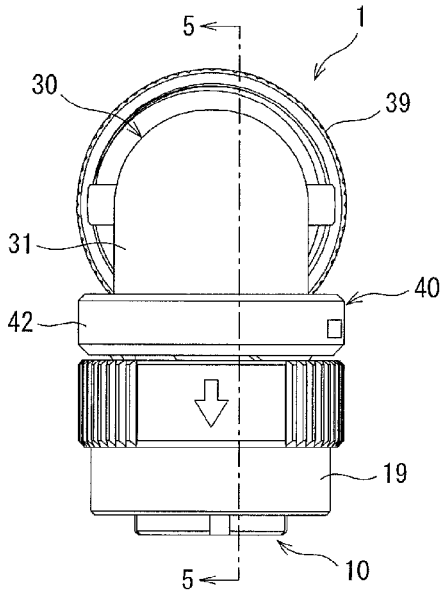
FIG. 2 is a front view of the connector shown in FIG. 1.

Further, as shown in FIG. 1, the end bell 30 is provided with a fitting portion 31 extending shown by arrow L and a cable attaching portion 32 extending in a direction perpendicular to the axial direction to be formed in an approximately L-shaped manner as viewed from a side thereof. The fitting portion 31 and the cable attaching portion 32 are formed in cylindrical shapes, respectively, and are coupled to each other, and they are integrally formed by molding synthetic resin. An approximately L-shaped receiving passageway 33 opened along a lower end face of the fitting portion 31 and along an end face of the cable attaching portion 32 is formed inside the fitting portion 31 and the cable attaching portion 32. As shown in FIG. 5, a portion of the receiving passageway 33 opened at the lower end face of the fitting portion 31 forms a barrel receiving section 33*a* fitted with the upper end portion of the barrel 10. Further, a portion of the receiving passageway 33 opened at the end face of the cable attaching portion 32 forms a cable receiving section for the cable C. A male screw portion 32*a* is provided on an outer circumference of the cable attaching portion 32.

Figure 3:
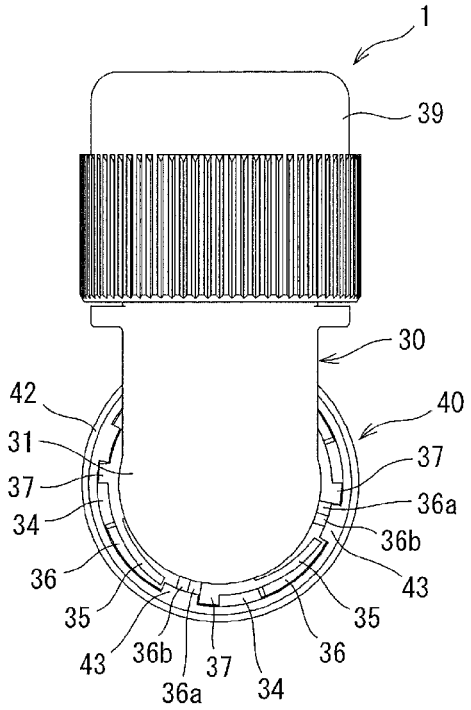
FIG. 3 is a top view of the connector shown in FIG. 1.
Figure 4:
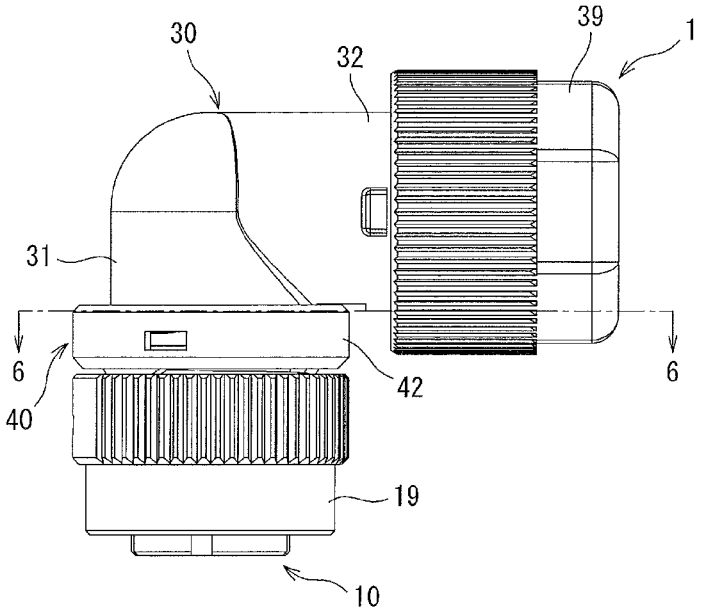
FIG. 4 is a right side view of the connector shown in FIG. 1.
Figure 17:
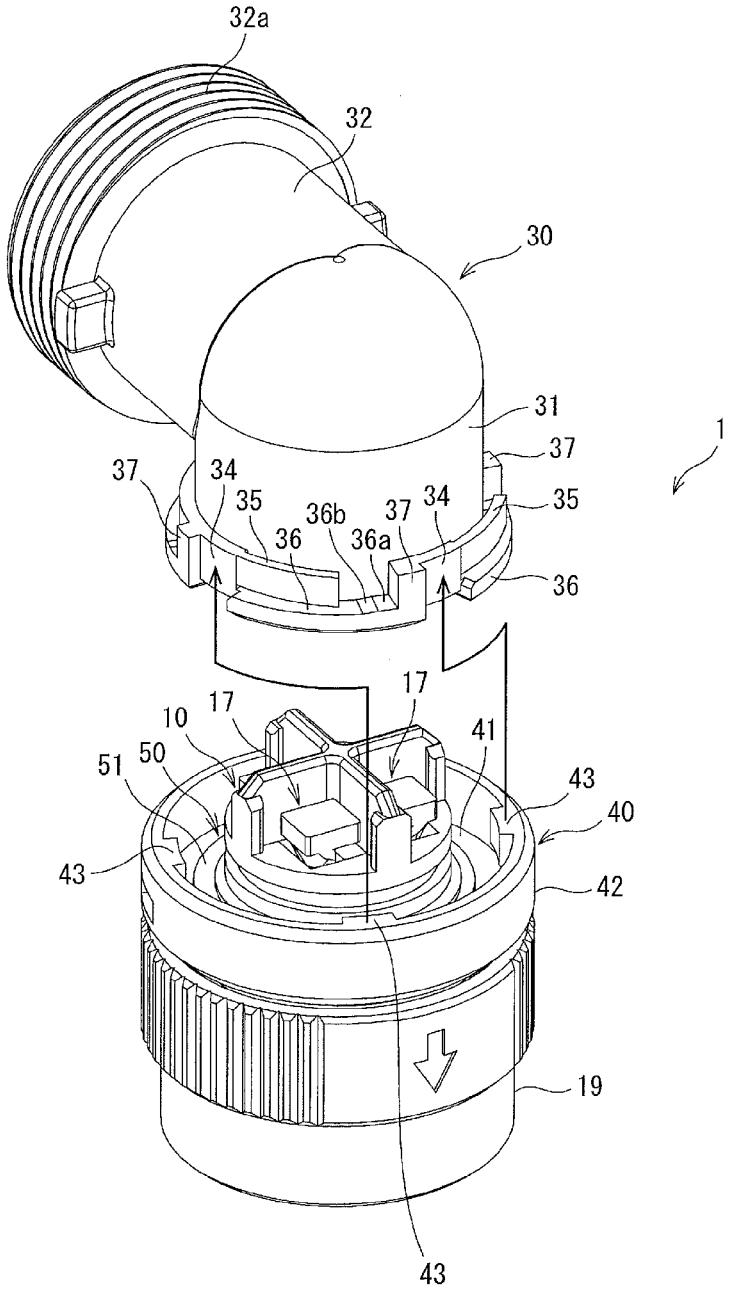
FIG. 17 is a perspective view of an assembly nut and an end bell for the connector of FIG. 1.

Further, as shown in FIG. 3, FIG. 6 and FIG. 17, four nut receiving slots 34 are provided along a lower end portion on the outer circumferential face of the fitting portion 31 and spaced at 90° intervals. Each nut receiving slot 34 is opened along a lower end face of the end bell 30. Each projection 43 of the assembly nut 40 described later can be inserted into the nut receiving slot 34 from a lower side of the end bell 30. Further, two spring arms 35 are provided on the outer circumferential face of the fitting portion 31 along a lower end thereof. As shown in FIG. 6 and FIG. 17, each of the two spring arms 35 extends from the respective vicinities of adjacent two nut receiving slots 34 of the four nut receiving slots 34 in a cantilever manner along the outer circumferential face of the fitting portion 31 in a counterclockwise direction. Further, as shown in FIG. 6, four seat portions 36 are provided on the outer circumferential face of the fitting portion 31 along a lower end portion thereof. As shown in FIG. 17, two seat portions 36 of the four seat portions 36 are formed so as to project from the outer circumferential face of the fitting portion 31 below the spring arms 35 and extend from the vicinities of the nut receiving slots 34 along the outer circumferential face of the fitting portion 31 such that they are longer than the spring arms 35. Thicker portions 36*a* of the two seat portions 36 are provided and formed to be longer than the spring arms 35 of the seat portions 36. As shown in FIG. 17, the thicker portion 36*a* includes a slope face 36*b* extending from a thinner portion of the seat portion 36 in an obliquely upward inclined manner. Further, the remaining two seat portions 36 project from the outer circumferential face of the fitting portion 31 at the same positions as the former two seat portions 36, and extend from the vicinity of the nut receiving slot 34 along the outer circumferential face of the fitting portion 31 so as have the same length as the former two seat portions 36. Further, four stopper projections 37 are provided on the outer circumferential face of the fitting portion 31 at the lower end portion. Each stopper projection 37 is formed on the outer circumferential face of the fitting portion 31 along a portion adjacent to the seat portion 36 opposite to the nut receiving slot 34.

As shown in FIG. 5 and FIG. 7, a cylindrical water-proof rubber seal 38*a* is inserted in the inner circumferential side of a portion of the cable attaching portion 32, and a clamp housing 38*b* is fitted on an outer circumferential side of the water-proof rubber seal 38*a*. Further, a female screw portion 39*a* of a water-proof rubber fastening member 39 is screwed to the male screw portion 32*a* of the cable attaching portion 32. As shown in FIG. 5, an inner diameter of the water-proof rubber seal 38*a* is approximately the same diameter as a diameter of the cable receiving section for the cable C. As shown in FIG. 5, for attaching the cable C, a distal end of the cable C is inserted through an inside through-hole of the water-proof rubber seal 38*a* so as to be located in the cable receiving section. Screwing of a water-proof rubber fastening member 39 is promoted to the male screw portion 32*a* of the cable attaching portion 32, so that the water-proof rubber seal 38*a* tightens the cable C from the outer circumferential side of the cable C. Thereby, sealing is achieved between the water-proof rubber seal 38*a* and the cable C.

Figure 10:
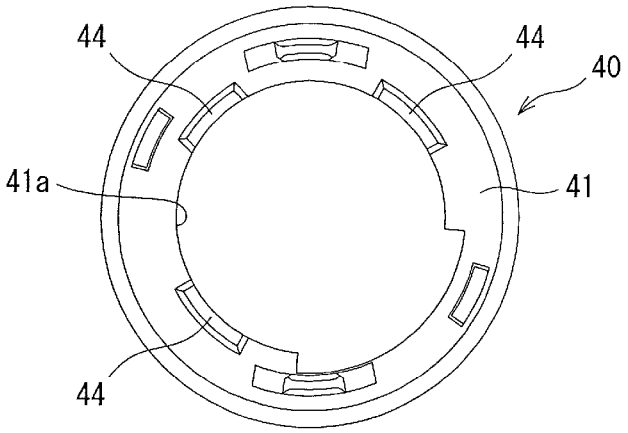
FIG. 10 is a bottom view of the assembly nut of FIG. 9.
Figure 11:
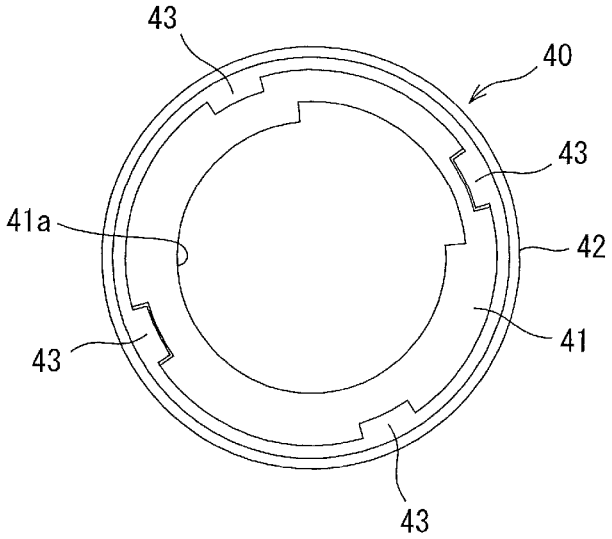
FIG. 11 is a top view of the assembly nut of FIG. 9.

Next, as shown in FIG. 7 and FIGS. 9 to 11, the assembly nut 40 is provided with an annular bottom plate 41 having a barrel receiving passageway 41*a* in which the barrel 10 can be inserted along a central portion thereof, and a cylindrical side wall 42 upstanding from an outer edge of the bottom plate 41. The assembly nut 40 is integrally formed by molding synthetic resin. Four projections 43 provided at 90° intervals along an upper end portion of the inner circumferential face of the side wall 42 so as to project inward. Further, as shown in FIG. 7 and FIG. 10, a plurality of (three in this embodiment) key grooves 44 in which a plurality of (three in this embodiment) keys 13 of the barrel 10 are inserted are formed in a lower face of the bottom plate 41 of the assembly nut 40. The plurality of key grooves 44 are arranged on an inner circumferential edge of the bottom plate 41 at intervals of 90°.

The barrel 10 and the assembly nut 40 are configured to be secured to each other by a securing mechanism 50 (see FIG. 7). The securing mechanism 50 is composed of a C ring 51 attached to the barrel 10, the above-described keys 13 formed on the barrel 10 and the above-described key grooves 44 formed in the assembly nut 40 into which the keys 13 of the barrel 10 are inserted. A method for fixing the barrel 10 and the assembly nut 40 to each other using the securing mechanism 50 will be described later.

Next, an assembling method of a connector assembly will be described with reference to FIG. 9 to FIG. 18.

As shown in FIG. 9, first, the ring housing 19 is attached to the barrel 10. For the attaching, as shown in FIG. 15, the annular plate 19*b* of the ring housing 19 is fitted between the upper stoppers 12*a* and the lower stoppers 12*b* of the barrel 10. Thereby, the ring housing 19 is rotatably attached to the barrel 10 such that movement thereof has been restricted. At this time, the ring housing 19 is biased in one direction of the rotation by the coil spring 18 wounded on the outer circumference of the barrel 10. The second seal member 21 is fitted in the second seal groove 16 in advance.

Figure 12:
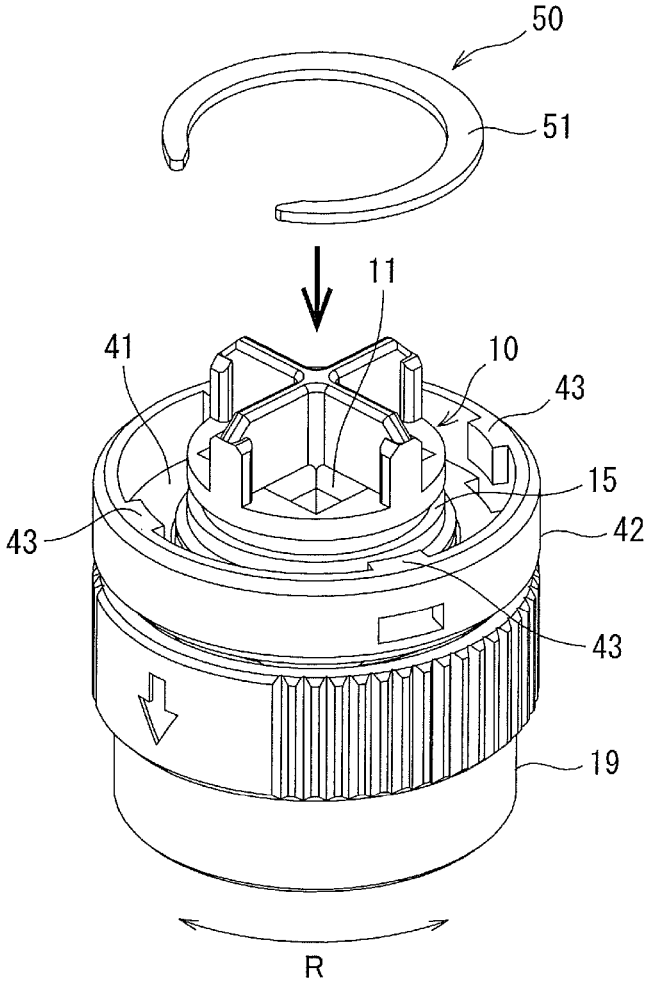
FIG. 12 is a perspective view of a C ring and a barrel of the connector shown in FIG. 1.
Figure 13:
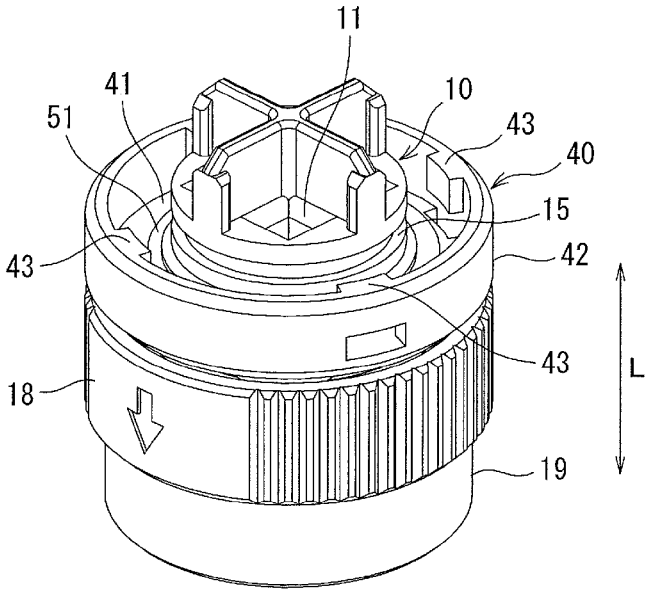
FIG. 13 is another perspective view of a C ring and a barrel of the connector shown in FIG. 1.
Figure 14:
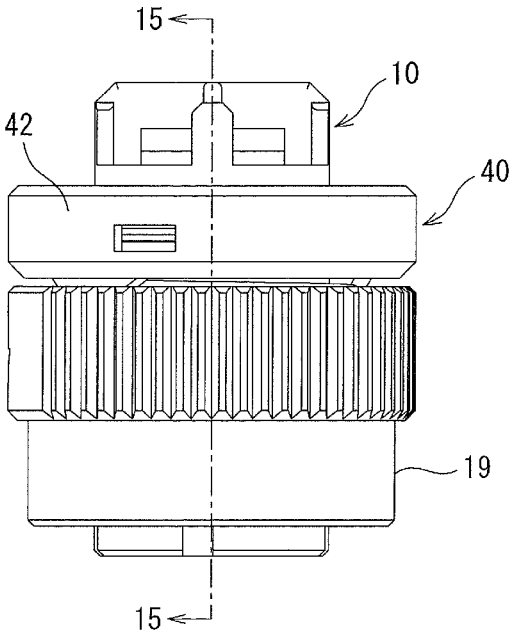
FIG. 14 is a front view of a connector according to the invention showing an assembly nut secured to a barrel thereof.

Next, as shown in FIG. 9 to FIG. 16, the assembly nut 40 is secured to the barrel 10 by the securing mechanism 50. As shown in FIG. 9, first, the keys 13 of the barrel 10 are fitted into the key grooves 44 of the assembly nut 40 from the above. Thereby, as shown in FIG. 12, the assembly nut 40 is located to the barrel 10 in the rotation direction shown by arrow R. Further, by fitting the keys 13 of the barrel 10 into the key grooves 44 of the assembly nut 40, as shown in FIG. 15, retaining the assembly nut 40 to the barrel 10 is achieved with respect to a downward direction, as shown by arrow L. Thereafter, as shown in FIG. 12, FIG. 13 and FIG. 15, the C ring 51 is attached to the barrel 10 by fitting the C ring 51 in the circumferential groove 14 of the barrel 10. Thereby, as shown in FIG. 13 and FIG. 15, retaining the assembly nut 40 to the barrel 10 is achieved with respect to an upward direction, as shown by arrow L. The first seal member 20 is fitted in the first seal groove 15 of the barrel 10.

Figure 18:
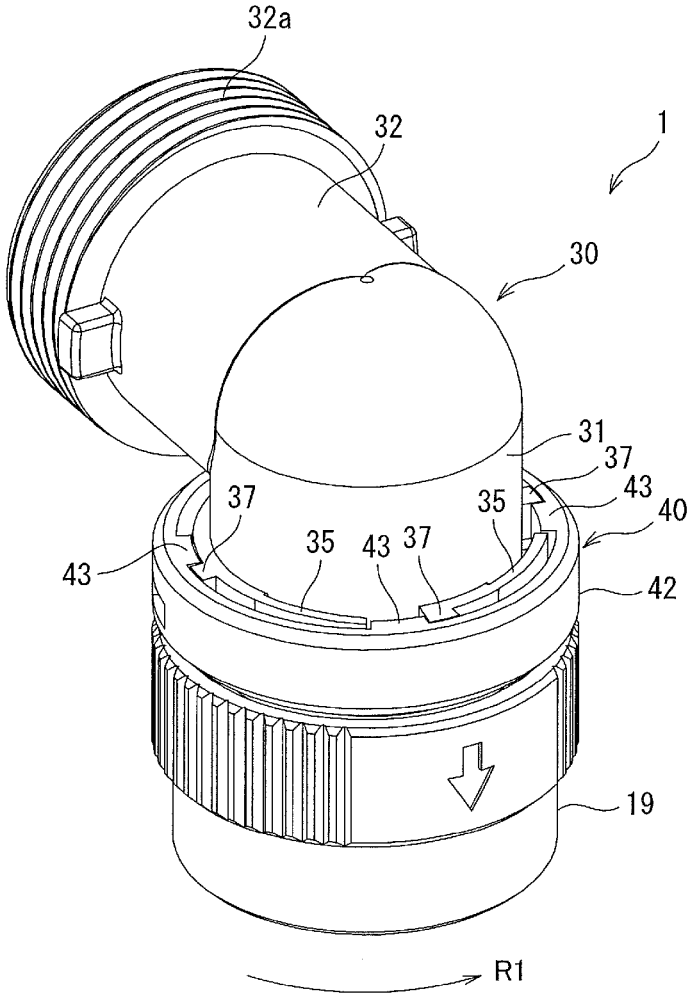
FIG. 18 is another perspective view of an assembly nut and an end bell for the connector of Figure.

After the assembly nut 40 is secured to the barrel 10, as shown in FIG. 17 and FIG. 18, the end bell 30 is secured to the assembly nut 40.

Here, each electrical wire of the cable C (see FIG. 5) is connected to each contact 17. Next, each contact 17 is inserted into the end bell 30 through the inside through-hole of the water-proof rubber seal 38*a* via the cable receiving section. Further, simultaneously, the distal end of the cable C is inserted into the end bell 30 through the inside through-hole of the water-proof rubber seal 38*a* and through the cable receiving section. Thereafter, as shown in FIG. 17, each contact 17 is received in each contact receiving chamber 11 of the barrel 10. Then, by screwing the water-proof rubber fastening member 39 to the cable attaching portion 32, the water-proof rubber seal 38*a* tightens the cable C from the outer circumference side of the cable C. Thereby, the cable C is connected to the end bell 30 such that sealing between the water-proof rubber seal 38*a* and the cable C has been achieved.

Thereafter, as shown in FIG. 17, two projections 43 of the assembly nut 40 are inserted into two nut receiving slots 34 provided in the spring arms 35 of the end bell 30. Here, as to the two projections 43 of the assembly nut 40, arbitrary two adjacent projections 43 are selected corresponding to an orientation direction of the cable C derived from the end bell 30. Thereafter, as shown in FIG. 18, by rotating the assembly nut 40 and the barrel 10 by a predetermined angle in the counterclockwise direction shown by arrow R1, the projection 43 of the assembly nut 40 is engaged with the distal end of the spring arm 35 of the end bell 30. Specifically, the projection 43 of the assembly nut is located between the distal end of spring arms 35 and the stopper projection 37. Thereby, locating of the end bell 30 to the assembly nut 40 in the rotation direction is achieved. Further, simultaneously therewith, the projection 43 of the assembly nut 40 is seated on the thicker portion 36*a* of the seat portion 36. Thereby, as shown in FIG. 5, the thicker portions 36*a* is sandwiched between the projection 43 and the bottom plate 41 of the assembly nut 40 from above and below, so that retention of the end bell 30 to the assembly nut 40 is achieved.

As shown in FIG. 5, the upper end portion of the barrel 10 is fitted in the barrel receiving section 33*a* of the fitting portion 31 of the end bell 30. A seal between the upper end portion of the barrel 10 and the barrel receiving section 33*a* is achieved by the first seal member 20.

Thus, in the connector 1 of the invention, the barrel 10 and the assembly nut 40 are secured to each other by the securing mechanism 50. Further, the projection 43 of the assembly nut 40 is engaged with the spring arm 35 of the end bell 30 and is disposed on the seat portion 36 of the end bell 30, so that the end bell 30 and the assembly nut 40 are secured to each other. Therefore, a large force is not required for assembly, and even if disassembly and assembly are repeated, the assembly nut 40 and the end bell 30 are prevented from being scraped or damaged, so that long a retaining force of the assembly nut 40 to the end bell 30 is prevented from being lowered.

Further, by fitting the key 13 of the barrel 10 in the key groove 44 of the assembly nut 40, retention of the assembly nut 40 to the barrel 10 is achieved with respect to the downward direction. Further, by attaching the C ring 51 to the barrel 10, retention of the assembly nut 40 to the barrel 10 with respect to the upward direction is also achieved. Therefore, the assembly nut 40 and the barrel 10 can be secured to each other by the securing mechanism 50 having a simple configuration, and the assembly nut 40 and the barrel 10 can be secured to each other by a simple operation.

Further, by rotating the assembly nut 40 and the barrel 10 by a predetermined angle after inserting the projection 43 of the assembly nut 40 into the nut receiving slot 34, locating of the end bell 30 to the assembly nut 40 is performed. Further, simultaneously, retaining of the end bell 30 to the assembly nut 40 regarding the upward direction and the downward direction are achieved. Therefore, the end bell 30 and the assembly nut 40 can be secured to each other by a simple operation.

Incidentally, when the end bell 30 is removed from the assembly nut 40, the spring arm 35 formed on the end bell 30 is displaced inward of the end bell 30 by a jig. Thereafter, by rotating the assembly nut 40 and the barrel 10 by the predetermined angle in a clockwise direction, the projection 43 is located at the nut receiving slot 34, so that the end bell 30 may be removed from the assembly nut 40. Therefore, removal of the end bell 30 from the assembly nut 40 can be performed by a simple work.

Further, when the orientation direction of the cable C extending from the end bell 30 is changed, and after the end bell 30 is removed from the assembly nut 40, the other two adjacent projections 43 corresponding to the orientation direction of the cable C are selected. Then, the end bell 30 may be secured to the assembly nut 40 according to the above-described method. Therefore, the orientation direction of the cable C derived from the end bell 30 can be changed without removing the assembly nut 40 from the barrel 10.

For example, the barrel 10 coupled to the end bell 30 by the assembly nut 40 is fitted to the header connector attached to the casing of a motor (not shown). At this time, the cam projection 19*c* of the ring housing 19 enters the cam groove formed on an outer face of the header connector, so that the barrel 10 and the header connector are secured to each other. At this time, sealing between the barrel 10 and the header connector is achieved by the second seal member 21.

The embodiment of the present invention has been described above, but the present invention is not limited to this embodiment and the embodiment has been modified or improved variously.

For example, it is not necessary to fit the barrel 10 to the header connector attached to the casing of the motor necessarily.

Further, the securing mechanism 50 is used secure the barrel 10 and the assembly nut 40, and it is not required to be composed of the key 13 formed in the barrel 10, the key groove 44 formed in the assembly nut 40, and the C ring 51 attached to the barrel 10 necessarily. Other designs are possible.

Besides the above description, the configurations described in the above embodiment can be selected or changed as appropriate to other configurations without departing from the spirit and scope of the present invention.

What is claimed is:

1. A connector, comprising:

a barrel;

an end bell having a spring arm and a seat portion;

an assembly nut having a projection disposed on the seat portion and engaging the spring arm to couple the assembly nut to the end bell; and a securing mechanism securing the barrel and the assembly nut to each other.

2. The connector according to claim 1, wherein the securing mechanism includes a key formed on the barrel.

3. The connector according to claim 2, wherein the securing mechanism further includes a key groove formed along the assembly nut into which the key of the barrel is inserted.

4. The connector according to claim 3, wherein the securing mechanism further includes a C ring attached to the barrel.

5. The connector according to claim 1, wherein the end bell includes a nut receiving slot in which the projection is inserted.

6. The connector according to claim 5, wherein the nut receiving slot is positioned along an outer circumferential face of the end bell.

7. The connector according to claim 6, wherein the spring arm extends in a cantilever manner from the nut receiving slot.

8. The connector according to claim 7, wherein the seat portion extends from the outer circumferential face of the end bell.

9. The connector according to claim 8, wherein the seat portion is positioned below the spring arm and extends from a vicinity of the nut receiving slot.

10. The connector according to claim 9, wherein the seat portion is longer than the spring arm.

11. The connector according to claim 10, further comprising a stopper projection disposed along the outer circumferential face of the end bell and on the seat portion opposite to the nut receiving slot.

12. The connector according to claim 11, wherein the assembly nut includes a bottom plate and a side wall upstanding from an outer edge of the bottom plate.

13. The connector according to claim 12, wherein the projection is disposed along an upper end portion of the side wall.

14. The connector according to claim 13, wherein the seat portion includes a sloped portion extending from a thinner portion to a thicker portion thereof.

15. The connector according to claim 1, wherein the end bell includes a fitting portion with an approximately L-shaped receiving passageway extending therethrough.

16. The connector according to claim 15, wherein the approximately L-shaped receiving passageway includes a barrel receiving section and a cable receiving section positioned opposite the barrel receiving section.

* * * * *